United States Patent [19]

Sugaya et al.

[11] 4,262,614

[45] Apr. 21, 1981

[54] PATTERN STITCH SEWING MACHINE HAVING MEANS FOR DETERMINING TIME OF OPERATOR INFLUENCE TO EFFECT VARIED MACHINE CONTROL

[75] Inventors: Takao Sugaya; Chikao Yamashita; Noriyuki Yoshida, all of Nagoya, Japan

[73] Assignee: Brother Kogyo Kabushiki Kaisha, Aichi, Japan

[21] Appl. No.: 100,434

[22] Filed: Dec. 5, 1979

[30] Foreign Application Priority Data

Dec. 21, 1978 [JP] Japan ..... 53-161464

[51] Int. Cl.[3] ..... D05B 3/02; D05B 69/22

[52] U.S. Cl. ..... 112/158 E; 112/275; 112/317

[58] Field of Search ..... 112/275, 277, 158 E, 112/316, 317, 121.11, 121.12

[56] References Cited

U.S. PATENT DOCUMENTS

| | | | |
|---|---|---|---|
| 3,827,381 | 8/1974 | Baanstra et al. | 112/121.11 |
| 4,108,090 | 8/1978 | Landau, Jr. et al. | 112/121.11 |
| 4,147,119 | 4/1979 | Dunn | 112/317 |
| 4,150,634 | 4/1979 | Brown et al. | 112/275 |

*Primary Examiner*—Peter P. Nerbun

*Attorney, Agent, or Firm*—Browdy & Neimark

[57] ABSTRACT

A sewing machine wherein a single operable button is capable of selectively performing a plurality of actions depending on the length of duration of the operation time. The machine is provided with a needle positioning device for arresting the needle at a certain predetermined position and a stitch forming system for forming a specific stitch pattern, and either of the two is actuated according to the length of duration of the operation time of the operable button. Furthermore, a forthcoming action of the machine can be varied in response not only to the length of duration of the operation time mentioned above but also to the state of the machine which can be in operation or stationary. The machine is thereby capable of performing a plurality of different actions by means of fewer operable buttons.

8 Claims, 6 Drawing Figures

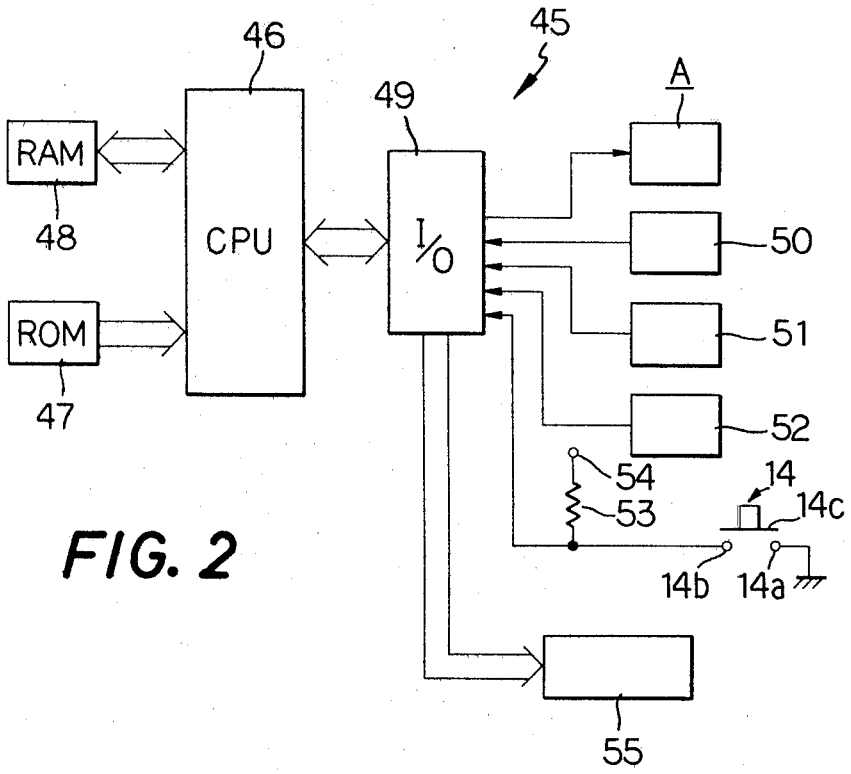
FIG. 2
FIG. 3
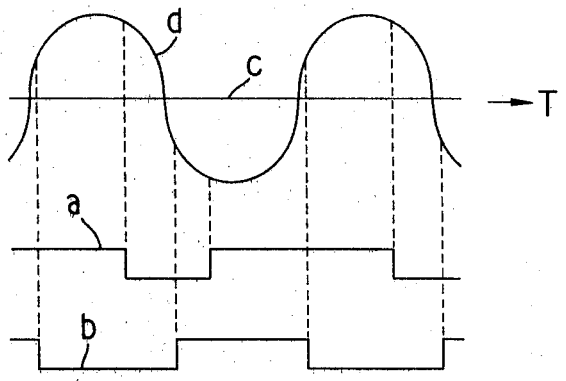

PWR ON
NEEDLE UP?
NP MERY RT
NP MERY ST
LS MERY RT
MTR ROT?
SLTPTN FORM
OPBTN ON?
0.25s TMR ST
TMR OVR?
FPLS STP
0.006s TMR ST
MTR BRK
100 CMD
RVm ≤ 200
0.1s TMR
LSDT OUT
LS MERY ST
LS MERY ST ?
NP SL UP?
NP SL DWN?
A
YES
NO

PATTERN STITCH SEWING MACHINE HAVING MEANS FOR DETERMINING TIME OF OPERATOR INFLUENCE TO EFFECT VARIED MACHINE CONTROL

BACKGROUND OF THE INVENTION

This invention relates to an automatic sewing machine, and in particular to the operation control thereof.

With the rapid progress of electronics technology in recent years, operations in a sewing machine such as sewing operation, speed control operation of a drive motor (electric motor), etc., have become to be placed under detailed processing control employing electronic controlling circuits, which has enabled a sewing machine to carry out many complicated operations and to have many improved functions. An enumeration of the functions newly developed includes: a function of arresting the needle at an upper position above the bed, a function of shifting the needle to a lower position for arresting the same there, a function of stopping the electric motor, in case of an emergency, by means of pressing a button other than the main button for the ordinary starting and stopping the electric motor, and a function of effectively selecting a desired stitch pattern from among a lot of stitch patterns by utilizing as few selecting buttons as possible, etc. Because these functions must be realized by the operator, by means of handling an operable means corresponding to each related function, so that the number of operable means is inevitably increased accompanied by the increasing number of the functions. Those operable means have to be usually arranged on a handy place for the operator, that is to say, on the front side of the machine facing to him or her, and this place is generally a limited and rather small one, being already occupied by the main button for the electric motor, a display panel for indicating a plurality of stitch patterns, selecting buttons for selecting a stitch pattern, etc., leaving little space to be spared. Arranging many kinds of operable means on the limited front side space detracts from the appearance of a sewing machine and likely to degrade the easiness of the operation (operability) of the machine. Each of the operable means has to be connected to an electronic controlling circuit respectively for being checked of its operation state, resulting in increase of the number of connecting lines, which naturally invites difficulty of wiring and sometimes mis-connecting of electric wiring. The reliability of sewing machines have been lowered by those troublesome problems.

SUMMARY OF THE INVENTION

An object of the invention is to provide a sewing machine wherein as few numbers of operating means as possible are capable of effectively performing as many of functions as possible.

Another object of this invention is to provide a sewing machine wherein one operating means is capable of selectively letting the needle arrest at a predetermined position or having a specific stitch pattern formed depending on the length of a time duration of the operation.

Still another object of this invention is to provide a sewing machine wherein a forthcoming operation can be varied depending not only on the length of the time duration of operation of the operating means but also on the state of the machine which can be in either a stopped or in an operation.

A further object of this invention is to provide a sewing machine excellent in operability and reliability.

For attaining the objects a sewing machine in accordance with this invention is provided with discriminating means for discriminating the length of the time duration of operation of an operable means.

In an instance where the present invention is applied, for example, to a sewing machine having stitch forming instrumentalities including an endwise reciprocative needle and a work feeding mechanism for transporting a workpiece to be sewn in timed relation with a reciprocal movement of the needle, drive means for imparting a reciprocal movement to the needle to produce a specific stitch pattern with the stitch forming instrumentalities, and needle positioning means for moving the needle to arrive at at least one predetermined position and arresting the needle thereat, the sewing machine may be provided with an operable means disposed on the front side of the machine; detecting means for determining whether the operation time when the operable means is operated is within a predetermined time or not; and control means for selectively actuating the drive means and the needle positioning means according to the discrimination.

In a sewing machine with such a structure the operable means is capable of selectively letting the needle arrest at a predetermined position or having a specific stitch pattern formed depending on the length of a time duration of the operation.

The control means preferably actuates the needle positioning means when the operation time is within the predetermined time and actuates the drive means when the operation time is beyond the predetermined time, and the drive means will preferably keep on imparting a reciprocal movement to the needle during the operation of the operable means after the control means actuates the drive means.

In a further improved sewing machine state detecting means for discriminating whether the machine is in a stationary state or in an operational state is disposed, in addition to the above-mentioned time detecting means for discriminating the length of the operation time of the operable means. A combined discrimination of the length of the operation time and the operational state of the machine enables the forthcoming operation of the machine to be changed according to the resultant information of that discrimination.

When this invention is applied to a sewing machine which is provided with an operable button for carrying out a specific stitching such as non-ravel stitching or seaming which has a predetermined stitch pattern for forming a straight stitch in a reverse feeding direction before and after the formation of a desired stitch pattern, the sewing machine can be operated in various modes as stated hereunder.

When this operable button is operated for a short time while the machine is in stoppage state, the arrested position of the needle is shifted (or switched). That is to say, the needle placed at the upper position above the bed is shifted to the lower position beneath the bed, and vice versa, the needle at the lower position is shifted to the upper position. When this operable button is operated for a long time while the sewing machine is stopped, the electric motor is driven at a low speed to allow the performance of the specific stitching; by the release of the operable button the stitching operation is interrupted to settle the needle at the upper position.

When on the other hand the operable button is operated for a short time while the machine is in operation, the electric motor is stopped instantly stopping the sewing operation of the machine. It means that the rotation of parts of the machine can be stopped in an emergency by a button other than the main button which effects ordinary starting and stopping of the machine. This is very effective as a safety measure of the sewing machine itself. When the operable button is operated for a long time while the machine is in operaton, a specific stitching such as non-ravel stitching can be formed following the formation of a desired stitch pattern during the operation time of the operable button. Releasing of the operable button settles the needle at the upper position to terminate the specific stitching.

In a sewing machine according to this invention, one operable means makes the machine perform plural kinds of operations. It allows the sewing mahine to have more functions without detracting from the appearance thereof. It makes it possible for the operator to eliminate a selective operation from plural operable means. It has become unnecessary, in addition, to dispose as many operable means as the number of different operations. The decrease of the number of operable means results in decreasing of the connection wiring between the operable means and the controlling system of the machine, diminishing the trouble occurrence such as faulty connection of the wiring. In addition, the operational state of the operable means can be easily detected and controlled by the electronic controlling circuit of the machine, because the circuit is suitable to discriminate and determine the operational state, not in amount of sewing but in the length of the operation time. This invention will surely contribute to the improvement and enlargement of the functions of the sewing machine a great deal.

BRIEF DESCRIPTION OF THE DRAWINGS

FIG. 2 is a general block chart of an electric controlling system of the above-mentioned sewing machine;

FIG. 3 is a timing diagram for explaining the operation of the above-mentioned sewing machine;

DETAILED DESCRIPTION OF THE PREFERRED EMBODIMENTS

Figure 1:
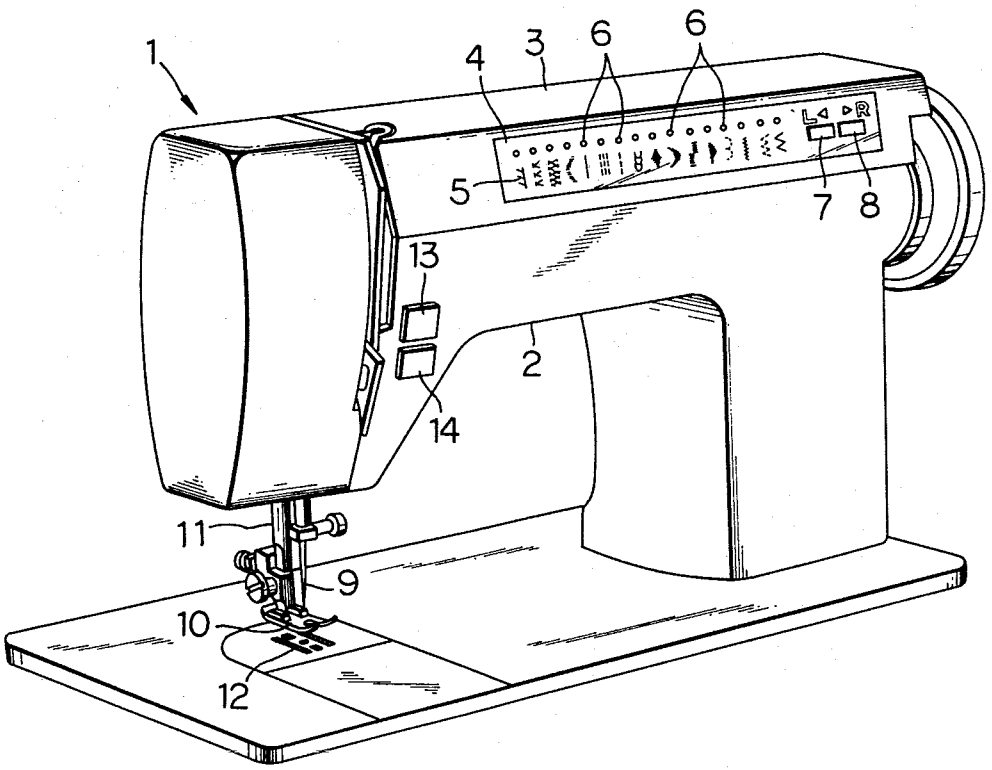
FIG. 1 is a general perspective view of a sewing machine in which this invention is incorporated.

This invention is applied to a sewing machine wherein a plurality kind of predetermined stitch patterns, for example 16 kinds, can be selectively formed. A frame 1 of the machine is provided with a bracket arm 2 which is cantilevered over a bed. The bracket arm 2 has a top cover 3 which is provided with a laterally elongated display panel 4 on its side wall portion facing the operator. On the display panel 4 indicia 5 for designating respective stitch pattern of the 16 kinds are laterally arranged side by side. Above each of the indicia 5 are arranged light emitting diodes (LED) 6. In the rightwardly biased part of the display panel 4 a first and a second select buttons, 7, 8 are disposed. A needle 9 is attached to a needle bar such that it is allowed vertically reciprocating movement interlocked with a main shaft (not show) and also laterally oscillating movement by means of a bight control device (not shown). A presser 10 is attached to a presser bar 11 disposed behind the needle 9 in a vertically movable manner, and a feed dog 12 feeds a work fabric in an adapted timing with the vertically reciprocating movement of the needle 9. The work fabric is controlled of its feeding direction and feeding amount by means of a not-shown feed control device. A main button 13 for the starting and stopping of the machine is disposed at a leftwardly biased portion on the front side of the bracket arm 2; just beneath the main button 13 an operable button 14 is disposed for carrying out a non-ravel stitching having a predetermined stitch pattern for forming a straight stitch in a reverse feeding direction.

Figure 4:
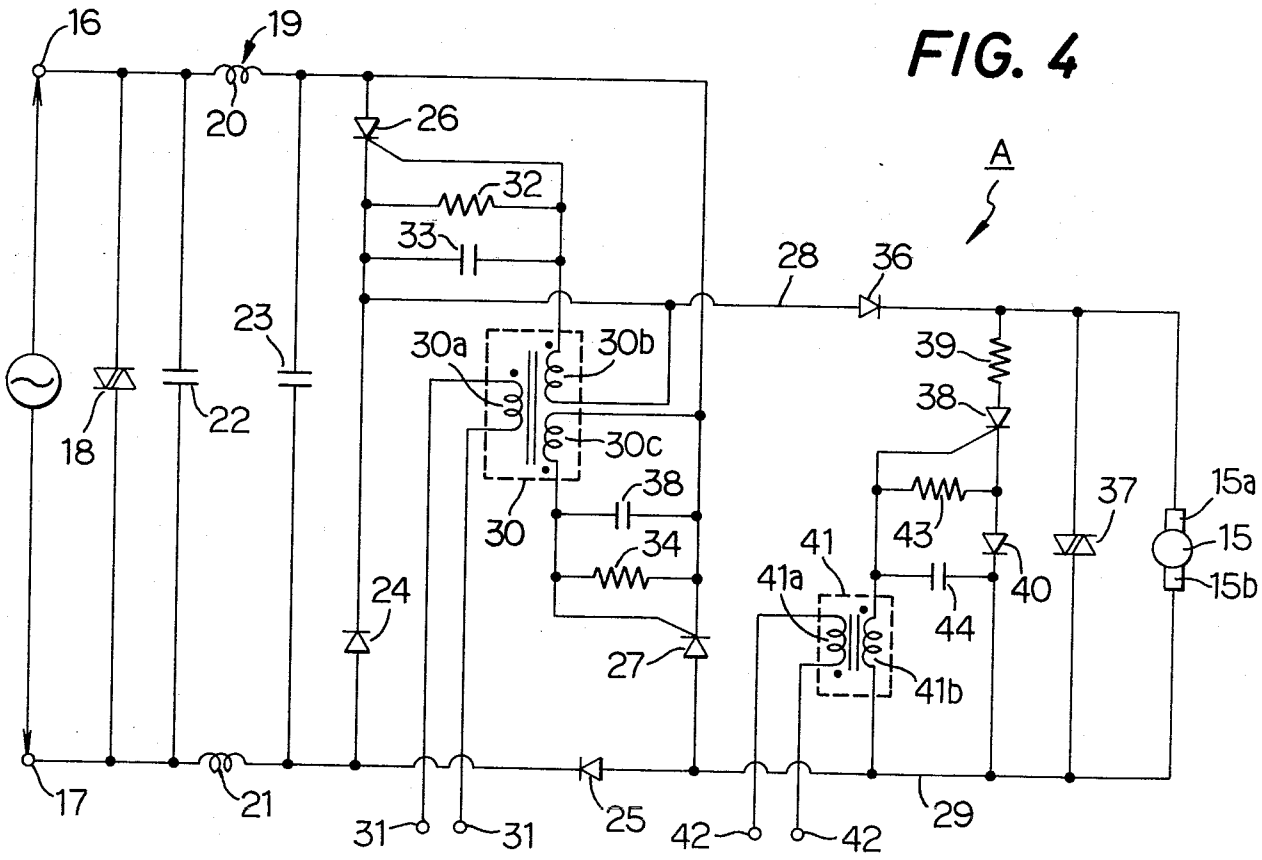
FIG. 4 is a circuit diagram for showing the detail of the operation controlling circuit for the electric motor.

A motor control circuit 60 for controlling the rotation of an electric motor 15 for driving the main shaft of the machine will be described hereunder with reference to FIG. 4. A semiconductor member 18 for surge suppression is connected between two of alternating current source terminals 16, 17, to each of which is respectively connected one end of a choke coil 20, 21. Between each one terminal of the both terminals of the choke coils 20, 21 is respectively connected a capacitor 22 and another capacitor 23. Those choke coils 20, 21 and capacitors 22, 23 constitute a noise filter 19; and diodes 24, 25 and silicon controlled rectifiers (thyristor) 26, 27 constitute a bridge circuit for full wave rectifying of an alternating voltage. An anode of one diode 24 and a cathode of the other diode 25 are connected to the other end of the choke coil 21; and an anode of one thyristor 26 and a cathode of the other thyristor 27 are respectively connected to the other end of the choke coil 20. Each cathode of the diode 24 and the thyristor 26 is connected to a positive source line 28 and each anode of the diode 25 and the thyristor 27 is connected to a negative source line 29. A transformer 30 is for supplying firing pulse to the thyristors 26, 27, and between input terminals 31, 31 of the primary winding **30*a* of the transformer 30 a pulse signal from the later described input-output device is given. A secondary winding 30*b* of the transformer 30 is connected between the gate and the cathode of the thyristor 26, and another secondary winding 30*c* of the same is connected between the gate and the cathode of the thyristor 27. A resistor 32 and a capacitor 33 are respectively connected in parallel to the secondary winding 30*b*, and a resistor 34 and a capacitor 35 are respectively connected in parallel to the secondary winding 30*c*. A terminal 15*a* of the electric motor 15 is, via a diode 36 for preventing a reverse current flow, connected to the positive source line 28, and the other terminal 15*b* of the electric motor 15 is connected to the negative source line 29. Between the terminals 15*a* and 15*b* of the electric motor 15 is connected a semiconductor member 37 for surge suppression. A thyristor 38 is for braking the electric motor 15, the anode of which is connected, via a resistor 39, to the terminal 15*a*, and the cathode is connected, via a diode 40 (for preventing reverse current flow), to the terminal 15*b*. A pulse-transformer 41 is for firing the thyristor 38, and between input terminals 42, 42 of the primary winding 41*a* of the same is imparted a pulse signal from the later described input-output device. The secondary winding 41***b* of the pulse-transformer 41 is connected at one end to the thyristor 38 and at the other end to the negative source line 29. A resistor 43 is connected between the gate and cathode of the thyristor 38 and a capacitor 44 is connected in parallel to the secondary winding 41*b*.

FIG. 2 shows a block diagram of an electric control apparatus 45, in which a read only memory 47 (ROM) memorizes permanently fixed information such as stitch pattern information and speed-setting information, etc., for selectively giving the fixed information to the central processor unit 46(CPU), and a random access memory 48 (RAM) memorizes processed information from the central processor unit 46 and information showing the operational state of the machine. An input-output device 49 gives input information to the central processor unit 46 and also gives the processed information from the central processor unit 46 to the actual operational part of the machine. Each operation of both memories 47, 48 and the input-output device 49 is controlled according to the program illustrated in the later described flow chart. The motor control circuit 60 is for, upon receiving drive information and brake information coming from the input-output device 49, driving (including the speed-setting) and braking (including the needle positioning) the electric motor 15. A rotation detector 50 is provided for detecting the number of rotation of the electric motor 15, which detector is constituted of, for example, a tachogenerator directly connected to the main shaft (not shown). Obtained information regarding the starting and stopping as well as the number of rotation of the electric motor 15 will be given to the input-output device 49.

A position detector 51 for detecting the needle position and a generator 52 for generating a timing signal generate, as shown in FIG. 3, a needle position signal S*a* and a timing signal S*b* for giving them to the input-output device 49. In FIG. 3 a base line c designates the bed surface on which the work fabric is laid, a curve d designates a locus of movement of the tip of the needle 9, and the abscissa is a time axis T. The needle position signal S*a* is an electric signal which falls, when the needle 9 has passed the highest possible point (top) and slightly descended, from high level to low level, and rises, when the needle 9 has reached a point slightly before the lowest possible point (bottom), from low level to high level. And the timing signal S*b* is an electric signal which falls, from high level to low level, when the needle 9 has slightly risen from the bed surface (designated by the base line c) and rises, from low level to high level, when the needle 9 has slightly descended from the bed surface. A normal open switch interlocked with the operable button 14 is provided with a pair of fixed contact pieces 14*a*, 14*b* and a movable contact piece 14*c*; the fixed contact piece 14*a* is grounded and the fixed contact piece 14*b* is connected, via resistor 53, to a positive source terminal 54. While the operable button 14 is in non-operation the fixed contact piece 14*b* is in a high level state, and when the operable button 14 is operated by depressing to make the movable contact piece 14*c* connect the pair of fixed contact pieces 14*a*, 14*b*, the fixed contact piece 14*b* is changed to low level, and the voltage varying of this fixed contact piece 14*b* is imparted as an electric signal to the input-output device 49. A stitch forming system 55 is composed of the bight control device which is driven in accordance with the output information from the input-output device 49 for laterally oscillating the needle 9 and the feed control device for controlling the feed amount and the feed direction of the work fabric.

Figure 5:
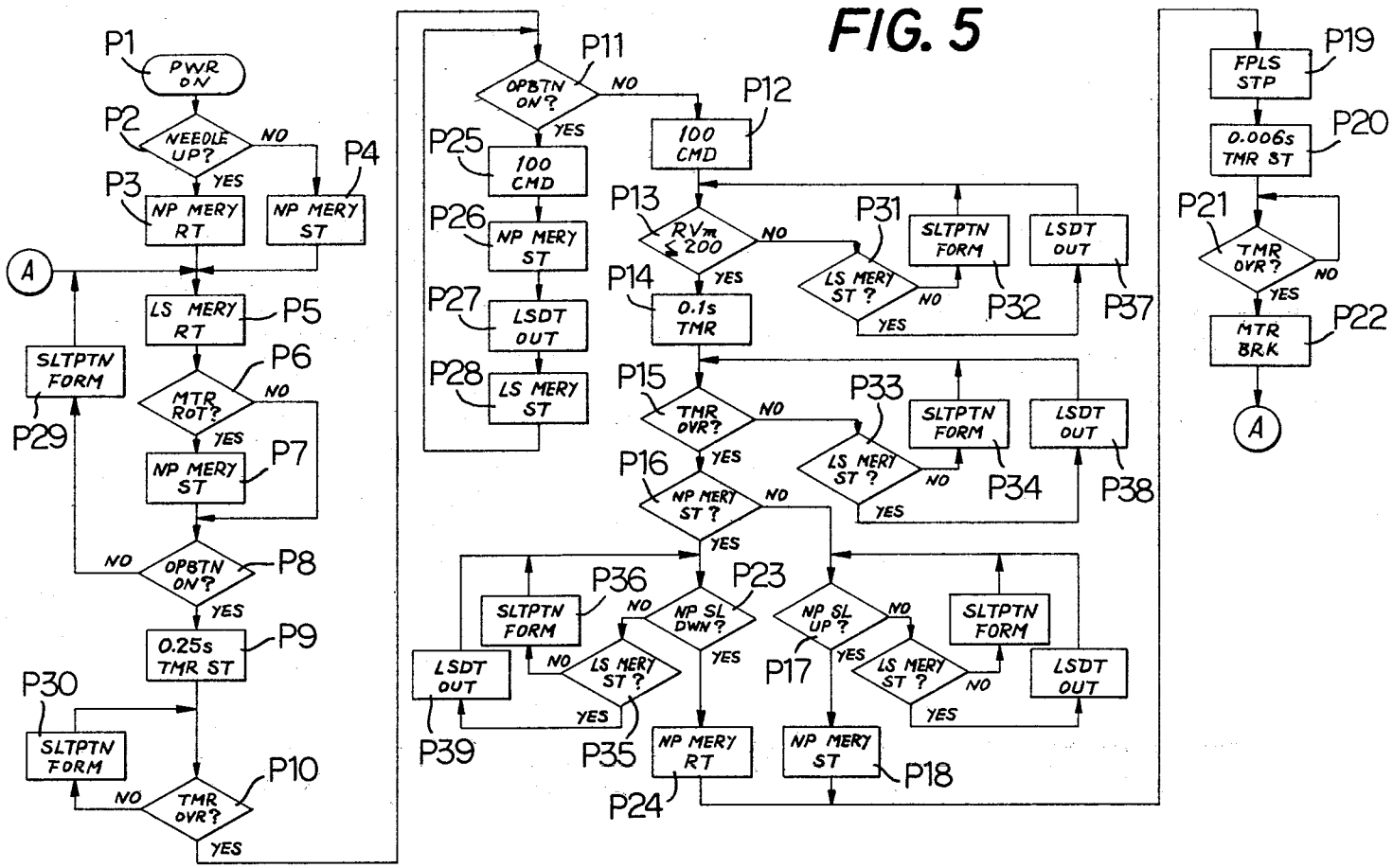
FIG. 5 is a flow chart for explaining the operation of the electric controlling circuit of a first embodiment of this invention.

With reference to the flow chart of FIG. 5, the way of controlling a portion which directly relates to this invention is to be described hereunder. For the purpose of better understanding of the explanation numerical signs will be alloted to the flow chart, and the signs on the flow chart are tabulated hereunder:

TABLE OF THE SIGNS ON THE FLOW CHART

| Process | Symbols | Brief Description |
|---|---|---|
| P1 | PWR ON | Power source on |
| P2 | NEEDLE UP? | Is the needle at upper position? |
| P3 | NP MERY RT | Reset NP memory |
| P4 | NP MERY ST | Set NP memory |
| P5 | LS MERY RT | Reset LS memory |
| P6 | MTR ROT? | Is the motor in rotation? |
| P7 | NP MERY ST | Set NP memory |
| P8 | OPBTN ON? | Is the operable button on? |
| P9 | 0.25s TMR ST | Set the 0.25 sec. timer |
| P10 | TMR OVR? | Is the timer's operation over? |
| P11 | OPBTN ON? | Is the operable button on? |
| P12 | 100 CMD | Output the 100 r.p.m. command |
| P13 | RVm ≦ 200 | Is the number of rotaton of motor not more than 200 r.p.m.? |
| P14 | 0.1s TMR | Set 0.1 sec. timer |
| P15 | TMR OVR? | Is the timer's operation over? |
| P16 | NP MERY ST? | Is NP memory set? |
| P17 | NP SL UP? | Has the needle position signal Sa risen? |
| P18 | NP MERY ST | Set NP memory |
| P19 | FPLS STP | Stop the supply of firing pulse signal |
| P20 | 0.006s TMR ST | Set the 6 milli sec. timer |
| P21 | TMR OVR? | Is the timer's operation over? |
| P22 | MTR BRK | Apply braking to the motor |
| P23 | NP SL DWN? | Has the needle position signal fallen? |
| P24 | NP MERY RT | Reset NP memory |
| P25 | 100 CMD | Output the 100 r.p.m. command |
| P26 | NP MERY ST | Set NP memory |
| P27 | LSINF OUT | Output the information for non-ravel stitching |
| P28 | LS MERY ST | Set LS memory |
| P29 | SLTPTN FORM | Form a selected stitch pattern other than non-ravel stitching |
| P30 | SLTPTN FORM | Form a selected stitch pattern other than non-ravel stitching |
| P31 | LS MERY ST? | Is LS memory set? |
| P32 | SLTPTN FORM | Form a selected stitch pattern other than non-ravel stitching |
| P33 | LS MERY ST? | Is LS memory set? |
| P34 | SLTPTN FORM | Form a selected stitch pattern other than non-ravel stitching |
| P35 | LS MERY ST? | Is LS memory set? |
| P36 | SLTPTN FORM | Form a selected stitch pattern other than non-ravel stitching |
| P37 | LSINF OUT | Output the information for non-ravel stitching |
| P38 | LSINF OUT | Output the information for non-ravel stitching |
| P39 | LSINF OUT | Output the informaton for non-ravel stitching |
| P5′ | LS MERY RT | Reset LS memory |
| P6′ | MTR ROT? | Is motor in rotation? |
| P7′ | NP MERY ST | Set NP memory |
| P8′ | OPBTN ON? | Is the operable button on? |
| P8″ | OPBTN ON? | Is the operable button on? |
| P9′ | 0.25s TMR ST | Set the 0.25 sec. timer |
| P10′ | TMR OVR? | Is the timer's operation over? |
| P29′ | SLTPTN FORM | Form a selected stitch pattern other than non-ravel stitching |
| P30′ | SLTPTN FORM | Form a selected stitch pattern other than non-ravel stitching |

When, to begin with, the operator puts the power source ON (P1), a descrimination process (P2) is performed for determining whether the needle position is up or not by an output from the generator 52; if the output from the generator 52 is then in low level and the needle 9 is positioned above the bed (YES) will come out, and if the output from the generator 52 is in high level and the needle 9 is positioned below the bed (NO) will come out. In case of (YES) the program is advanced to a reset step (P3) of NP memory (needle position memory) for resetting NP memory in the random access memory 48; in case of (NO) to a set step (P4) of NP memory for setting NP memory in the random access memory 48. When either the reset step (P3) of NP memory or the set step of NP memory is over the program will be advanced to a reset step (P5) of LS memory (non-ravel stitching memory) for resetting LS memory in the random access memory 48. Another discrimination process (P6) is then executed for discriminating whether the motor 15 is in rotation or not by an output signal from the rotation detector 50. If the motor is in rotation (YES) will come out and otherwise (NO) will come out. (YES) advances the program to a set step (P7) of NP memory for setting NP memory in the random access memory 48 and further advances to a discrimination process (P8) for discriminating whether a switch interlocked with the operable button 14 is ON or not; (NO) result of the discrimination process (P6) advances the program directly from the discrimination process (P6) to the discrimination process (P8) without carrying out the set step (P7) of NP memory.

Now the explantion will be proceeded to a case wherein when the operator put the power source ON the needle 9 is at the upper position and then the operable button 14 is depressed for a short period of time within 0.25 sec. In this instance, the electric motor 15 is stationary when the operable button 14 is depressed because of the main button 13 being not operated after the putting ON (switching on) the power source (P1). When the power source is put ON (P1) the discrimination process (P2) shows (YES) discrimination because of the upper position of the needle 9 for resetting NP memory by the reset step (P3) and the discrimination process (P6) shows (NO) discrimination because of the stopping of the electric motor 15 without advancing to the reset step (P7) of NP memory; and then the discrimination process (P8) executes a discrimination of (YES) for advancing to a set step (P9) of 0.25 sec. timer. The program will further advance soon after the setting of the set step (P9) of the 0.25 sec. timer to a discrimination process (P10), which performs a discrimination whether the time measuring operation of the timer, a time measuring means, is over or not. The 0.25 sec. passes after the setting of the timer (YES) comes out, until then the discrimination being (NO). Upon descriminating (YES) in the discrimination process (P10) the program will be advanced to a discrimination process (P11) for discriminating whether the operable button 14 is ON or not. When it is affirmative (YES) will come out; when it is OFF the discrimination will be (NO). The program is, however, further advanced, after showing the (NO) discrimination in the discrimination process (P11) to a 100 r.p.m. setting step (P12) of the electric motor 15 because the operable button 14 was depressed only for a short period of time. In this step (P12) information setting the electric motor 15 at 100 r.p.m. is read out from the read only memory 47 by the central processor unit 46 for giving a suitable firing pulse to that speed, via the input-output device 49, in between the input terminals 31, 31 of the motor control circuit 60, and in turn rotating the electric motor 15. Following this step (P12) a discrimination process (P13) is ececuted for discriminating whether the number of rotation of the electric motor 15 is not more than 200 r.p.m. or not. In this process (P13) a comparison between the information from the rotation detector 50 and the rotational speed information from the read only memory 47 is made in the central processor unit 46. As a result of the comparison, rotational speed of the motor 15 not more than 200 r.p.m. gives (YES) discrimination, and not less than 200 r.p.m. gives (NO) discrimination. this discrimination process (P13) is immediately executed when the electric motor 15 is set in the step (P12) at 100 r.p.m. for being started, so the result will be (YES). The program will be advanced to a setting step (P14) of a 0.1 sec. timer followed by transferring to a discrimination process (P15) for discriminating whether the time measuring operation is over or not. If the 0.1 sec. timer is terminated (YES) discrimination will come out to advance in turn to a discrimination process (P16), wherein discrimination is performed in respect of discriminating whether NP memory is set or not. The NP memory is already reset in the reset step (P3), so (NO) discrimination comes out in this discrimination process (P16) for being advanced to a discrimination process (P17), wherein discrimination is performed for discriminating whether a needle-position signal S*a* has risen or not. If the needle-position signal S*a* from the position detector 51 rises (YES) discrimination will come out to advance the program to a set step (P18) of NP memory to in turn set NP memory in the random access memory 48. Upon the setting of NP memory the program will be immediately advanced to a process (P19) for stopping the supply of firing pulse in between the input terminals of the motor control circuit 60. After having finished the process (P19) the program will be advanced to a set step (P20) of a 6 milli sec. timer in order to set the same for being further transferred to a discrimination process (P21) wherein discrimination is performed regarding whether the time counting operation has finished or not. While the timer is working (not yet finished) (NO) discrimination will come out for maintaining the discrimination process (P21) for some more time. When the timer has finished its operation the discrimination process (P21) will turn to (YES) for being transferred to a braking process (P22) of the electric motor 15, wherein a firing pulse is given in between the input terminals 42, 42 of the motor control circuit 60 with a result of turning the thyristor 38 ON. So a short circuit will arise between the terminals 15*a* and 15*b* of the electric motor 15 through the resistor 39, the thyristor 38, and diode 40 for carrying out a dynamic braking, which brings about a stoppage of the electic motor 15, with the needle 9 being shifted from the upper position to the lower position.

Another case, in which the needle 9 is positioned down when the operator has put the power source ON and afterwards the operable button 14 is depressed for a short time less than 0.25 sec., will be described next. The discrimination process (P2) shows, in this instance, (NO) discrimination, so NP memory in the random access memory 48 is set by the set step (P4). Thereafter the same process from (P5) to (P15) as in the previous case will be followed in the order, finally reaching the discrimination process (P16). As NP memory is already set in the set step (P4), (YES) discrimination will naturally come out in the discrimination process (P16) for being advanced to a discrimination process (P23), wherein discrimination is performed for discriminating whether the needle position signal S*a* has fallen or not. When the needle-position signal S*a* from the position detector 51 falls (YES) discrimination will come out for being advanced to a reset step (P24) of NP memory. NP memory in the random access memory 48 is consequently reset. Processing from (P19) to (P22) will be followed as in the previous case after the finish of the reset step (P24). The electric motor 15 will be stopped in a state wherein the needle 9 has been shifted from the lower position to the upper position.

As can be understood from the detailed description set out above, when the operable button 14 is put ON again for a short period of time less than 0.25 sec., after the needle 9 has been shifted from the upper position to the lower position, all the processes as far as the discrimination process (P16) are executed similarly to the previous description, and the processes from the discrimination process (P23) to the braking process (P22) of the motor 15 will be advanced due to the (YES) discrimination in the discrimination process (P16), because the NP memory is already set in the previous operation of the set step (P18). The electric motor 15 is consequently stopped in a state where the needle 9 has been returned from the lower position to the upper position. When the operable button 14 is again put ON for a short period of time less than 0.25 sec., while the needle 9 is at the upper position, processes as far as the discrimination process (P16) are performed in the same way as previously mentioned and (NO) discrimination will come out in the discrimination process (P16), because of the already setting of NP memory in the reset step (P24) in the previous operation, for performing the processes or steps from (P17) to (P22). The electric motor 15 is stopped in a state where the needle 9 has been shifted from the upper position to the lower position.

The description now turns to an instance where the operable button 14 is put ON for a long period of time not less than 0.25 sec. while the electric motor 15 is stopped (stationary). The processes as far as the discrimination process (P11) are carried out just in the same manner as the foregoing description. As the operable button 14 is maintained ON even after the 0.25 sec. has elapsed, (YES) discrimination will come out from the discrimination process (P11); a 100 r.p.m. set step (P25), an NP memory set step (P26), a non-ravel stitching information output process (P27), and an LS memory set step (P28) are carried out in the order. In the 100 r.p.m. set step (P25) a responding firing pulse to that speed is supplied, in the similar manner as in the above-mentioned step (P12), in between the input terminals 31, 31 of the motor control circuit 60 for starting the electric motor 15; in the NP memory set step (P26) an NP memory in the random access memory 48 is set; in the non-ravel stitching information output process (P27) information for the non-ravel stitching is synchronously read out with the reciprocation of the needle 9 from the read only memory 47 by the central processor unit 46 for outputting the information, via the input-output device 49, to the stitch forming system 55; and in the LS memory set step (P28) the LS memory in the random access memory 48 is set. When the step (P28) is finished the program is advanced again to the discrimination process (P11) for repeatedly performing each step and process from the discrimination process (P11) to the step (P28), while operable button 14 is maintained ON and performing the non-ravel stitching in accordance with the information produced in the process (P27). When the operable button 14 is released of depression to become OFF after the non-ravel stitching has been performed for a corresponding time of that button depression the discrimination result of the discrimination process (P11) will be (NO) for advancing the program to the process (P12), and each step and process from the process (P12) to the discrimination process (P16) is carried out in the same order as mentioned above. The discrimination result in the discrimination process (P16) will be (YES), because of the NP memory being set in the step (P26), for performing each step and process from the discrimination process (P23) to the process (P22) in the same manner as mentioned above. The electric motor 15 is therefore stopped when the needle 9 has reached the upper position.

For forming various stitch patterns, on the other hand, the first select button 7 or the second select button 8 is operated ON to light desired one of the LEDs 6 positioned right above the indicia 5 representing desired stitch patterns, then a pattern code signal representing the desired stitch pattern is input as a commanding signal, via the input-output device 49, to the central processor unit 46. When the main button 13 is depressed ON after having finished the non-ravel stitching, etc., a command for starting the electric motor 15 is input, via the input-output device 49, to the central processor unit 46, whereby a firing pulse is supplied from the central processor unit 46, via the input-output device 49, in between the input terminals 31, 31 of the motor control circuit 60 for starting the electric motor 15. In this situation the central processor unit 46 makes an (YES) discrimination in the discrimination process (P6) of the flow chart, because of the electric motor 15 being in rotation, and a (NO) discrimination in the discrimination process (P8), because of the operable button 14 not being ON, for performing a stitch pattern forming process other than the non-ravel stitching (P29). In the process (P29) the central processor unit 46 selectively reads out the information from the read only memory 47 for forming a stitch pattern corresponding to an indicium 5 indicated by the LED 6 for giving the information to the stitch forming system 55. The machine is therefore held in a state wherein the selected stitch pattern other than the non-ravel stitching is formed. And while the selected stitch pattern is formed in this manner the central processor unit 46 circulates each of the steps and the processes (P5), (P6), (P7), (P8), and (P29) in every one reciprocation of the needle 9. And the electric motor 15 can be driven at any desired speed by a speed setting apparatus which is operated by an operator, being usually so set as to be driven at a speed not less than 200 r.p.m.

Next a case, wherein the operable button 14 is turned ON for a short period of time within 0.25 sec., while a selected stitch pattern other than the non-ravel stitching is formed, will be described. The moment when the operable button 14 is turned ON the discrimination result of the discrimination process (P8) will be (YES) to carry out the step (P9) and the discrimination process (P10) in the order. As the discrimination process (P10) keeps the (NO) discrimination for the period of 0.25 sec. until the timer terminates the measuring operation, for allowing based on this discrimination result to continuously execute a process (P30) of forming a stitch pattern other than the non-ravel stitching which has been previously selected by the operator. When the discrimination result in the discrimination process (P10) is turned to (YES) due to the termination of the timer's operation, the program is advanced in the same manner stated above to the discrimination process (P11), wherein (NO) discrimination is made, owing to a turning ON of the operable button 14 only for a short period of time, for being advanced after the performance of the process (P12) to the discrimination process (P13). The electric motor 15 which had been rotated at a speed not less than 200 r.p.m. until immediate before the advancement to the step (P12) needs a certain time duration due to its inherent inertia before it is decelerated down to 100 r.p.m. set in the step (P12). (NO) discrimination in the discrimination process (P13) advances the program to the discrimination process (P31) for discriminating whether the LS memory is set or not. Then the LS memory is maintained in a reset state by the above-mentioned step (P5), (NO) discrimination comes out to advance the program to the stitch pattern forming process (P32) other than the non-ravel stitching for continuing the formation of the stitch pattern selected by the operator. When the rotation speed of the electric motor 15 is decelerated down to less than 200 r.p.m. (YES) discrimination comes out in the discrimination process (P13) for advancing the program to the step (P14) in order to set a 0.1 sec. timer. The program advances further to the discrimination process (P15). During the time until the termination of the 0.1 sec. timer the rotation speed of the electric motor 15 comes down from 200 r.p.m. to 100 r.p.m., the set speed. As the discrimination in the discrimination process (P15) keeps (NO) until the timer terminates, the program is advanced to a discrimination process (P33) for discriminating again whether the LS memory is set or not. The then coming out (NO) discrimination advances the program, just like in the case of the discrimination process (P31), to a stitch pattern forming process (P34) other than the non-ravel stitching in order to further continue the formation of the selected stitch pattern. (YES) discrimination in the discrimination process (P15) due to the termination of the timer moves the program to the discrimination process (P16), which makes (YES) discrimination, because of the NP memory being set in the above-mentioned step (P7), to advance the program to the discrimination process (P23). (NO) discrimination continues until the needle-position signal falls in this process (P23), so the program advances to a discrimination process (P35) for discriminating again whether the LS memory is set or not. (NO) discrimination in this process (P35) advances the program to a stitch pattern forming process (P36) other than the non-ravel stitching for continuously forming the selected stitch pattern until the needle-position signal falls. When the discrimination result of the discrimination process (P23) turns to (YES) due to the falling of the needle-position signal, each step and process from the step (P24) to the process (P22) is performed to stop the electric motor 15, with the needle being maintained at the upper position.

A case wherein the operable button 14 is depressed ON for a long period of time not less than 0.25 sec. while the machine is forming a selected stitch pattern other than the non-ravel stitching is to be described hereunder.

Turning ON of the operable button 14 causes performance of each process as far as the discrimination process (P11), similarly to a case wherein the operable button 14 is depressed for a short period of time within 0.25 sec. while a selected stitch pattern is formed as stated above. (YES) discrimination comes out in the discrimination process (P11), just like in the above description, for performing each process between the step (P25) and the step (P28) in order to carry out the non-ravel stitching. Releasing depression of the operable button 14 for turning OFF after having formed the non-ravel stitching for a desired period of time by the operator makes the discrimination result in the discrimination process (P11) (NO), which advances the program, via the step (P12), to the discrimination process (P13). If the rotation speed of the electric motor 15 is then above 200 r.p.m., the discrimination result of the discrimination process (P13) turns out (NO) for advancing the program to the discrimination process (P31), where (YES) discrimination will be given, because of the LS memory being set in the above-mentioned step (P28) to advance the program to a non-ravel stitching information outputting process (P37). As the non-ravel stitching information is given in this process (P37), just like in the above-mentioned process (P27), to the stitch forming system 55 synchronously with the reciprocation of the needle 9, the non-ravel stitching can be continuously formed. Besides, in a case where the electric motor 15 is rotated at a speed less than 200 r.p.m. due to a relatively long operation of the forming of non-ravel stitching by the depression of the operable button 14, the discrimination process (P13) gives (YES) discrimination. With a turning of the discrimination result of the discrimination process (P13) to (YES), the program is promoted, via the step (P14), to the discrimination process (P15) for maintaining (NO) discrimination in the discrimination process (P15) until the 0.1 sec. timer terminates the measuring operation, so the program advances to the discrimination process (P33) so long as the discrimination result of the discrimination process (P15) keeps on (NO) discrimination, which causes the program to advance, with the discrimination process (P33) producing (YES) discrimination because of the LS memory being already set, to a non-ravel stitching information output process (P38) for continuing, just similarly to the above-mentioned process (P37), formation of the stitches for the non-ravel stitching. When the discrimination process (P15) gives (YES) discrimination due to termination of the timer's operation, the discrimination result of the discrimination process (P16) turns to (YES) due to the setting of the NP memory in the above-mentioned step (P26) for advancing the program to the discrimination process (P23). As the discrimination keeps (NO) in this process (P23) until the needle-position signal falls, the program continues to advance to the discrimination process (P35). As the discrimination result of the discrimination process (P35) is (YES), because of the LS memory being set as stated above, a non-ravel stitching information output process (P39) is carried out for continuously forming stitches for non-ravel stitching, similarly to the statement in the above description, until the fall of the needle-position signal. When the needle position signal falls the discrimination process (P23) gives (YES) discrimination to cause each of the steps and processes between (P24) and (P22) to be carried out; and the electric motor 15 is stopped, with the needle 9 being maintained at the upper position. Performance of the process (P22) successively causes performance of the step (P5), which brings about a resetting of the LS memory which has been set in the step (P28).

In the embodiment the needle 9 can be altered its position, when the operable button 14 is turned ON for a short period of time while the electric motor 15 is stationary, so that it is shifted downwards when it is in the upper position and upwards when it is in the lower postion respectively; when the operable button 14 is turned ON for a long period of time while the electric motor 15 is stationary, stitches for the non-ravel seaming are formed so long as the operable button 14 is ON, and when it is turned OFF the non-ravel stitching is terminated, with the needle 9 being arrested at the upper position. When the operable button 14 is turned ON for a short period of time while a selected stitch pattern other than the non-ravel stitching is being formed, with the electric motor 15 being in rotation, the rotation of the motor 15 is gently decelerated to arrest the needle 9 at the upper position and then the motor 15 is stopped with the termination of forming of the selected stitch pattern; when the operable button 14 is turned ON for a long period of time while a selected stitch pattern other than the non-ravel stitching is being formed, with the electric motor 15 being in rotation, the rotation of the motor 15 is gently decelerated to shift the machine operation to the formation of stitches for the non-ravel stitching, which is continued so long as the operable button is kept ON. And when the operable button 14 is turned OFF the needle 9 is arrested at the upper position.

Figure 6:
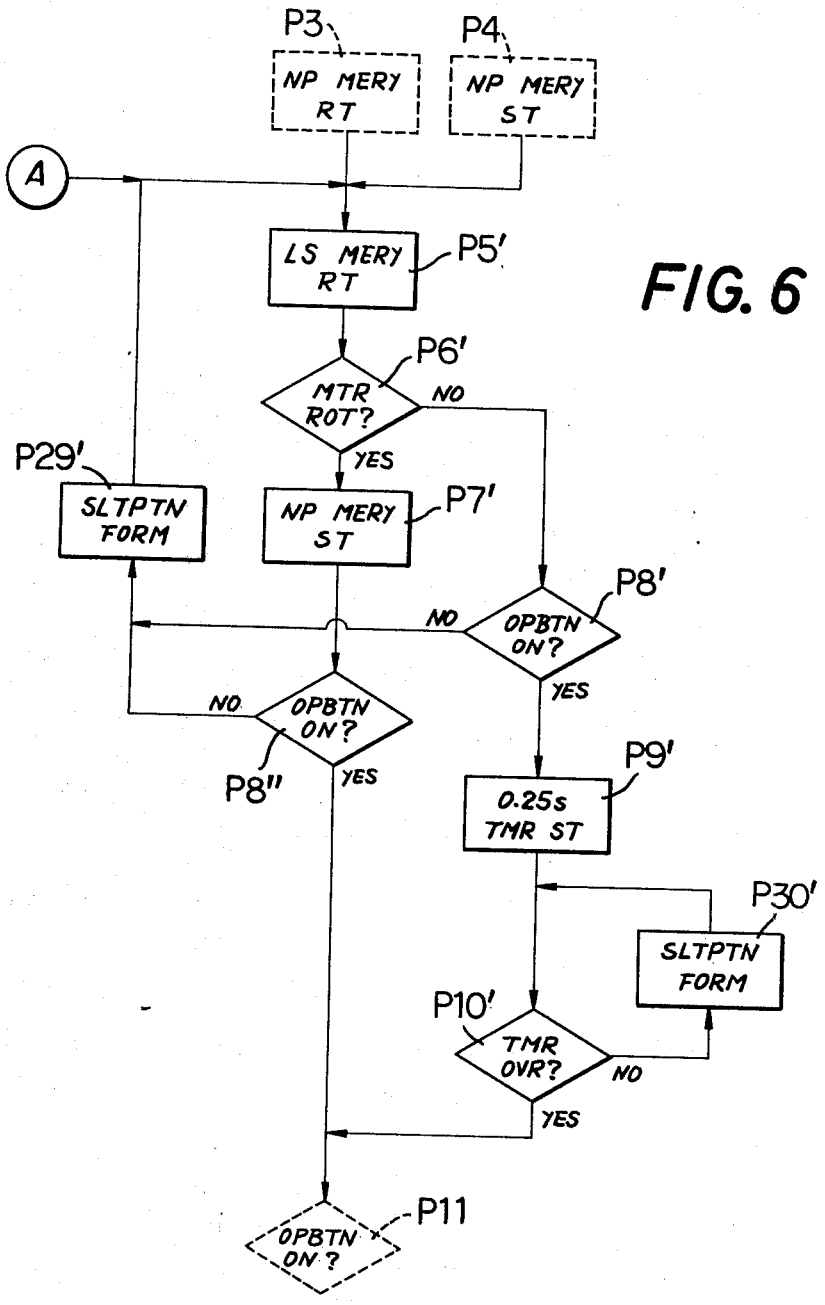
FIG. 6 is another flow chart for showing only the different part from that in FIG. 5 in order to explain the operation of the electric controlling circuit of a second embodiment of this invention.

In this embodiment above described, in case of an ON operation of the operable button 14 while a selected stitch pattern other than the non-ravel stitching is formed, a formation of stitches for the non-ravel stitching and an arresting of the needle 9 at the upper position will be selectively carried out depending on the length of the operation time duration of the operable button 14, but it is of course permissible to change the program such that an ON operation of the operable button 14 during the formation of the selected stitch pattern causes an instantaneous switching over to the formation of the non-ravel stitching irrespective of the length of the operation time duration. In this instance, the function of the operable button 14 can be changed by means of substituting the processes indicated in FIG. 6 with solid lines for the processes from the step (P5) to the process (P10) in FIG. 5.

What is claimed is:

1. A sewing machine having stitch forming instrumentalities including an endwise reciprocative needle and a work feeding mechanism for transporting a workpiece to be sewn in timed relation with a reciprocal movement of the needle, drive means for imparting movement to said stitch forming instrumentalities to produce a specific pattern, and needle positioning means for moving said needle to arrive at at least one predetermined position and arresting the needle thereat, said sewing machine comprising:

an operable means disposed on the front side of said machine;

means for discriminating whether the operation time when said operable means is operated is within a predetermined time or not; and control means responsive to said discrimination for actuating said needle positioning means when said operation time is within said predetermined time and actuating said drive means when said operation time is beyond said predetermined time.

2. A sewing machine according to claim 1, wherein said drive means is operatively arranged to keep on imparting movement to said stitch forming instrumentalities during the operation of said operable means after said control means actuates the drive means.

3. A sewing machine according to claim 1, wherein the discrimination of said means for discriminating and the actuation of said control means are performed by a computing unit according to a predetermined control program, said computing unit including a read only memory for permanently storing said predetermined control program and information for forming said specific stitch pattern, and wherein said computing unit is connected with said drive means to apply said information thereto.

4. A sewing machine according to claim 3, wherein said specific stitch pattern is a stitch pattern for a non-ravel stitching, and said information includes command indicative of a speed of said sewing machine for said non-ravel stitching and data indicative of a straight stitch in a reverse feeding direction.

5. A sewing machine having stitch forming instrumentalities including an endwise reciprocative needle and a work feeding mechanism for transporting a workpiece to be sewn in timed relation with the reciprocal movement of the needle, comprising:

drive means for imparting movement to said stitch forming instrumentalities to produce a specific stitch pattern;

needle positioning means for moving said needle to arrive at one position of two predetermined positions and arresting the needle thereat;

said needle positioning means having an upper positioning mode for arresting said needle at an upper position predetermined above the bed surface of said sewing machine and a lower positioning mode for arresting said needle at a lower position predetermined below the bed surface;

an operable means disposed on the front side of said sewing machine;

time discriminating means for discriminating whether the operation time when said operable means is operated is within a predetermined time duration or not;

state discriminating means for discriminating whether said sewing machine is in an operation state where any one of predetermined patterns is being produced by said stitch forming instrumentalities or in a state where the production of pattern has been stopped; and control means for selecting one actuation from among a first actuation for producing said specific stitch pattern, a second actuation for arresting said needle at said upper position and a third actuation for alternately changing the positioning mode between said upper and lower positioning modes according to the discriminations of said both discriminating means, and for selectively actuating said drive means and said needle positioning means to perform the selected actuation.

6. A sewing machine according to claim 5, wherein said control means actuates said needle positioning means to alternately change the positioning mode between said upper and lower positioning modes when said time discriminating means discriminates said operation time being within said predetermined time and said state discriminating means discriminates said sewing machine being in said stoppage state.

7. A sewing machine according to claim 5, wherein said control means includes memory means for temporarily storing the positioning mode of said needle positioning means.

8. A sewing machine having stitch forming instrumentalities including an endwise reciprocative needle and a work feeding mechanism for transporting a workpiece to be sewn in timed relation with a reciprocal movement of the needle, drive means for imparting movement to said stitch forming instrumentalities to produce a specific stitch pattern, and needle positioning means for moving said needle to arrive at at least one predetermined position and arresting the needle thereat, the sewing machine comprising:

an operable means accessible to a sewing machine operator on the front side of said sewing machine, said operable means being normally in a first state and being changed into a second state by the operator;

timer means responsive to the change from said first state to said second state for performing a time measuring operation during a predetermined time;

means for discriminating whether said operable means is in said first state or in said second state after the lapse of said predetermined time; and control means for selectively actuating said drive means and said needle positioning means according to the discrimination.

* * * * *